US008907578B2

(12) United States Patent
Hruby et al.

(10) Patent No.: US 8,907,578 B2
(45) Date of Patent: Dec. 9, 2014

(54) AUTONOMOUS METHOD AND SYSTEM FOR MINIMIZING THE MAGNITUDE OF PLASMA DISCHARGE CURRENT OSCILLATIONS IN A HALL EFFECT PLASMA DEVICE

(71) Applicants: Vladimir Hruby, Newtown, MA (US); Nathaniel Demmons, Mason, NH (US); Eric Ehrbar, Newton, MA (US); Bruce Pote, Sturbridge, MA (US); Nathan Rosenblad, Quincy, MA (US)

(72) Inventors: Vladimir Hruby, Newtown, MA (US); Nathaniel Demmons, Mason, NH (US); Eric Ehrbar, Newton, MA (US); Bruce Pote, Sturbridge, MA (US); Nathan Rosenblad, Quincy, MA (US)

(73) Assignee: Busek Co., Inc., Natick, MA (US)

( * ) Notice: Subject to any disclaimer, the term of this patent is extended or adjusted under 35 U.S.C. 154(b) by 281 days.

(21) Appl. No.: 13/621,342

(22) Filed: Sep. 17, 2012

(65) Prior Publication Data

US 2013/0093350 A1 Apr. 18, 2013

Related U.S. Application Data

(60) Provisional application No. 61/627,064, filed on Sep. 16, 2011.

(51) Int. Cl.

| | |
|---|---|
| ***H05H 1/00*** | (2006.01) |
| ***H05B 41/14*** | (2006.01) |
| ***H05H 1/54*** | (2006.01) |
| *F03H 1/00* | (2006.01) |

(52) U.S. Cl.

CPC . *H05H 1/00* (2013.01); *H05H 1/54* (2013.01); *F03H 1/0075* (2013.01)

USPC ..... 315/201; 315/267

(58) Field of Classification Search

USPC ..... 315/201, 267, 200 R, 111.41

See application file for complete search history.

(56) References Cited

U.S. PATENT DOCUMENTS

| | | | | |
|---|---|---|---|---|
| 5,423,970 | A * | 6/1995 | Kugler | 204/298.03 |
| 6,899,527 | B2 * | 5/2005 | Quon et al. | 417/49 |
| 7,294,969 | B2 * | 11/2007 | Kuninaka | 315/111.21 |
| 2007/0188104 | A1 * | 8/2007 | Chistyakov et al. | 315/111.21 |

OTHER PUBLICATIONS

U.S. Appl. No. 61/627,064, Vladimir Hruby.

William A. Hargus, Jr., "A Diagnostic for Hall Thruster Boron Nitride Insulator Erosion", JANNAF Meeting, May 2004, pp. 1-8.

Fife et al., "A Numerical Study of Low-Frequency Discharge Oscillations in Hall Thrusters", American Institute of Aeronautics and Astronautics, AIAA-97-3052, 33rd Joint Propulsion Conference, Jul. 1997, pp. 1-11.

William A., Hargus, Jr., "Optical Boron Nitride Insulator Erosion Characterization of a 200 W Xenon Hall Thruster", AIAA-2005-3529 Joint Propulsion Conference, Tucson, AZ, 10 pgs.

* cited by examiner

*Primary Examiner* — Daniel D Chang

(74) *Attorney, Agent, or Firm* — Teska & Coleman, LLP

(57) ABSTRACT

An autonomous method for minimizing the magnitude of plasma discharge current oscillations in a Hall effect plasma device includes iteratively measuring plasma discharge current oscillations of the plasma device and iteratively adjusting the magnet current delivered to the plasma device in response to measured plasma discharge current oscillations to reduce the magnitude of the plasma discharge current oscillations.

26 Claims, 6 Drawing Sheets

AUTONOMOUS METHOD AND SYSTEM FOR MINIMIZING THE MAGNITUDE OF PLASMA DISCHARGE CURRENT OSCILLATIONS IN A HALL EFFECT PLASMA DEVICE

RELATED APPLICATIONS

This application claims benefit of and priority to U.S. Provisional Application Ser. No. 61/627,064 filed Sep. 16, 2011 under 35 U.S.C. §§119, 120, 363, 365, and 37 C.F.R. §1.55 and §1.78 incorporated herein by this reference.

GOVERNMENT RIGHTS

This invention was made with U.S. Government support under Contract No. NNX09CD12P awarded by the NASA Phase I SBIR. The Government may have certain rights in the subject invention.

FIELD OF THE INVENTION

This invention relates to an autonomous method and system for minimizing the magnitude of plasma discharge current oscillations in a Hall Effect plasma device.

BACKGROUND OF THE INVENTION

Plasma discharge current from a plasma device such as Hall effect or similar type plasma device is known to be unstable and oscillatory. Because lifetime erosion is proportional to its power and the instantaneous power at the peak current is very high, the large magnitude of plasma discharge current oscillations are suspected to cause increased erosion and reduced the lifetime of the plasma device. Some evidence that plasma discharge current oscillations may reduce lifetime of a Hall plasma device is disclosed in *Optical Boron Nitride Insulator Erosion Characterization of a* 200*W Xenon Hall Plasma device*, by Hargus et al., AIAA-2005-3529, 41st Joint Propulsion Conference, July 2005, incorporated by reference herein. As disclosed therein, an increased boron nitride presence in the plasma was correlated with discharge oscillations.

One conventional method to minimize the magnitude of plasma discharge current oscillations is to manually adjust the amount of magnet current delivered to the plasma device. However, manually adjusting the magnet current is cumbersome and may not be performed when the plasma device is operational.

SUMMARY OF THE INVENTION

In one aspect, an autonomous method for minimizing the magnitude of plasma discharge current oscillations in a Hall effect plasma device is featured. The method includes iteratively measuring plasma discharge current oscillations of the plasma device and iteratively adjusting the magnet current delivered to the plasma device in response to measured plasma discharge current oscillations to reduce the magnitude of the plasma discharge current oscillations.

In one embodiment, adjusting the magnet current delivered to the plasma device may be constrained by the DC value of the plasma discharge current. The method may include iteratively measuring the AC component magnitude of the plasma discharge current oscillations. The method of claim may include determining the root-mean-square (RMS) value of the plasma discharge current oscillations. The method may include calculating the slope of the AC component value as a function of the magnet current. The method may include determining if the slope is positive or negative. The method may include changing magnet current set point by a predetermined amount in response to the determined slope. The method may include decreasing the magnet current set point when the slope is positive and increasing the magnet current set point when the slope is negative. The method may include determining if the magnet current set point is within an allowable range of magnet current for a given plasma device operating point. The method may include changing the magnet current when the current set point is within the allowable range. The method may include not changing the magnet current when the current set point is outside the allowable range. The method may include measuring the peak-to-peak value of the AC component. The method may include measuring the frequency of the plasma discharge current oscillations and adjusting the magnet current to reduce the magnitude of the plasma discharge current oscillations based in the measured frequency.

In another aspect, an autonomous method for minimizing the magnitude of plasma discharge current oscillations of a Hall effect plasma device is featured. The method includes iteratively measuring plasma discharge current oscillations of the plasma device and iteratively adjusting the magnet current delivered to the plasma device in response to measured plasma discharge current oscillations to reduce the magnitude of the plasma discharge current oscillations constrained by the DC value of the plasma discharge current.

In another aspect, a system for minimizing the magnitude of plasma discharge oscillations of a Hall effect plasma device is featured. The system includes a power processing unit configured to provide magnet current and power to the plasma device to establish plasma discharge current. A plasma discharge current measurement circuit is configured to measure plasma discharge current oscillations. A closed loop controller responsive to measured plasma discharge current oscillations is configured to iteratively adjust the magnet current delivered to the plasma device to reduce the magnitude of plasma discharge current oscillations.

In one embodiment, the closed loop controller may be configured to iteratively measure the AC component magnitude of the plasma discharge current oscillations. The closed loop controller may be configured to determine the root-mean-square (RMS) value of the plasma discharge current oscillations. The closed loop controller may be configured to calculate the slope of the AC component value as a function of the magnet current. The closed loop controller may be configured to determine if the slope is positive or negative. The closed loop controller may be configured change magnet current set point by a predetermined amount in response to the determined slope. The closed loop controller may be configured to decrease the magnet current set point when the slope is positive and increasing the magnet current set point when the slope is negative. The closed loop controller may be configured to determine if the magnet current set point is within an allowable range of magnet current for a given plasma device operating point. The closed loop controller may be configured to change the magnet current when the current set point is within the allowable range. The closed loop controller may be configured to not change the magnet current when the current set point is outside the allowable range. The closed loop controller may be configured to determine the peak-to-peak value of the AC component. The closed loop controller may be configured to measure the frequency of the plasma discharge current oscillations and adjust the magnet current to reduce the magnitude of the plasma discharge current oscillations based on the measured frequency.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1A:
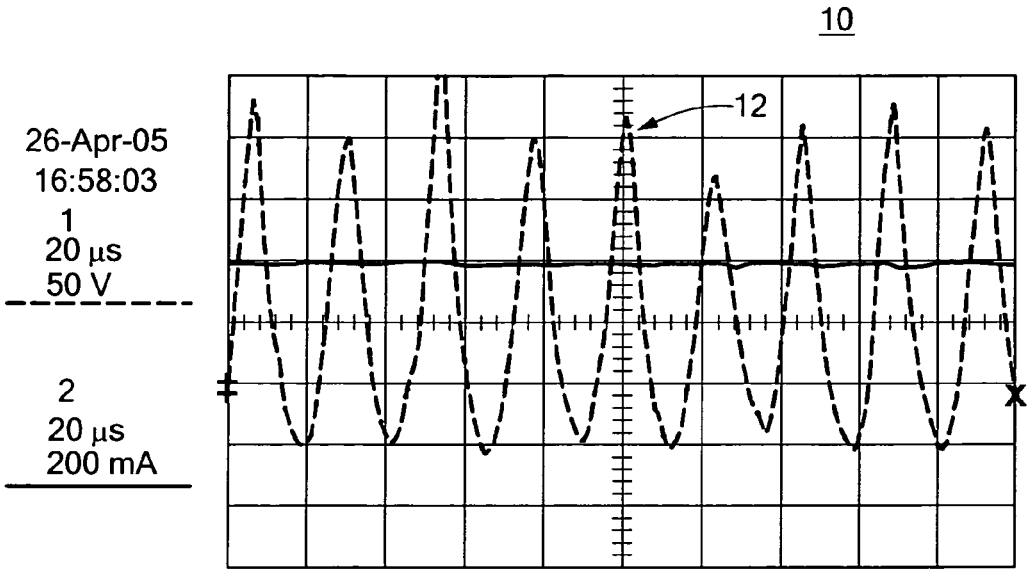
FIG. 1A is a plot showing an example of large magnitude plasma discharge current oscillations at a particular magnet current.
Figure 1B:
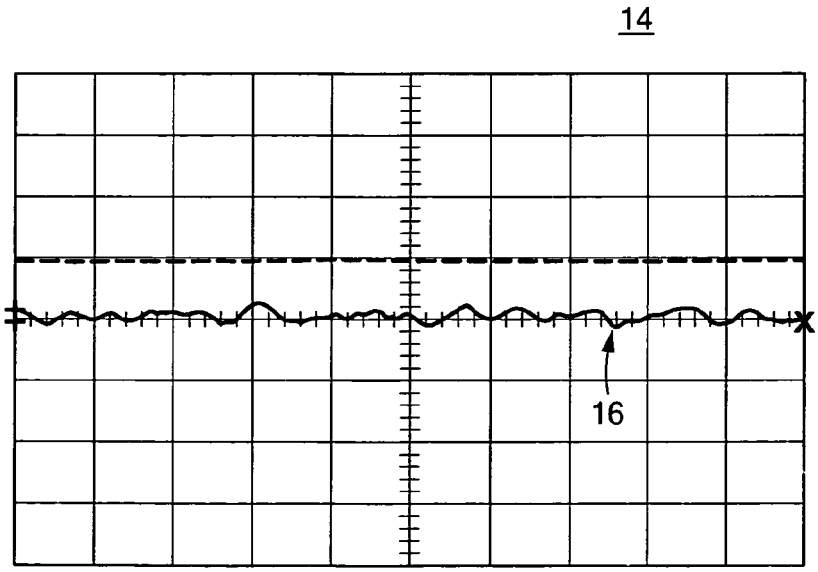
FIG. 1B is a plot showing an example of the reduction in the magnitude of the plasma discharge current oscillations when the magnet current is manually adjusted to a particular magnet current.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As discussed in the Background section, plasma discharge current from a plasma device, such as a Hall Effect plasma device or similar type plasma device, is known to be unstable and oscillatory. The large magnitude of the plasma discharge current oscillations may cause erosion which may reduce the lifetime of the plasma device. Plot 10, FIG. 1A, shows an example of oscillatory nature of plasma discharge current from a plasma device where the large magnitude plasma discharge current oscillations are indicated at 12. In this particular example, the magnet current provided to the plasma device was at about 1.25 amps. Plot 14 shows an example where the magnet current delivered to the plasma device was manually adjusted, in this example to about 0.66 A, to minimize the magnitude of the plasma discharge current oscillations, shown at 16. However, manually adjusting the magnet current is cumbersome and may not be performed while the plasma device is operational.

Figure 2:
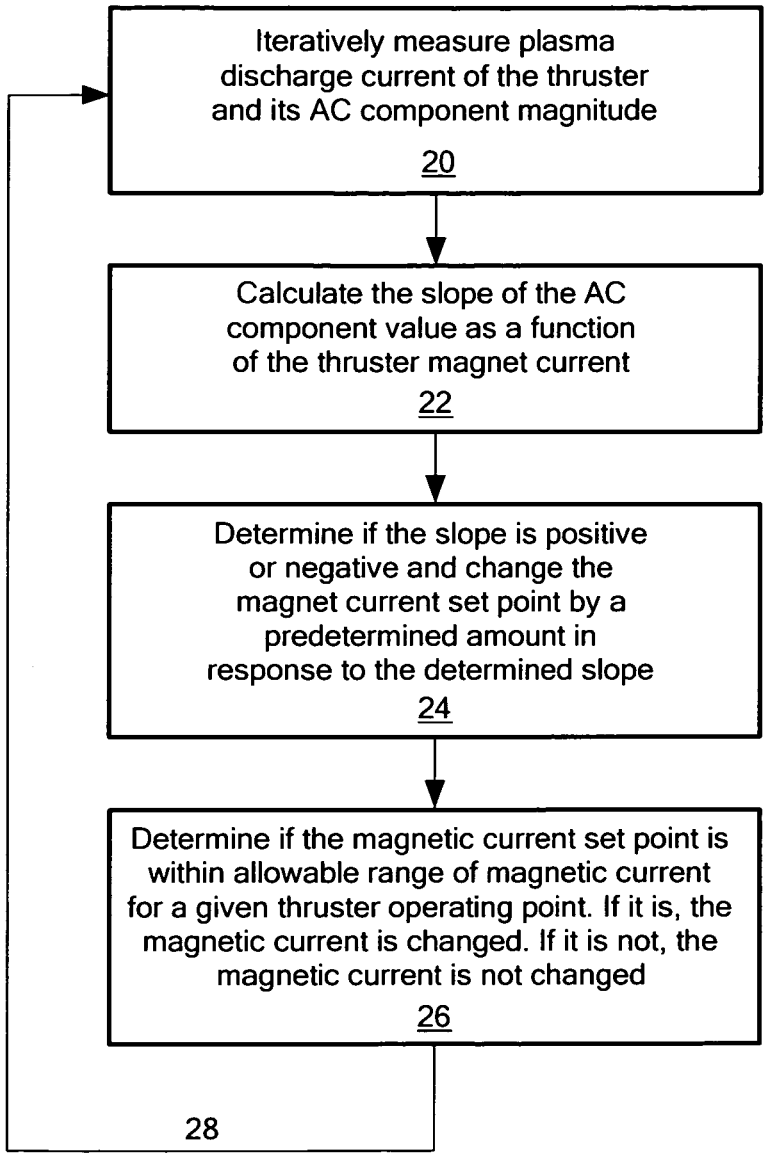
FIG. 2 is a flow chart of one embodiment of the autonomous method for minimizing the magnitude of Hall effect plasma discharge current oscillations in a plasma device of this invention.

The method of autonomously minimizing the magnitude or amplitude of plasma discharge current oscillations of a Hall effect plasma device of one embodiment of this invention includes iteratively measuring plasma discharge current oscillations in plasma device, step 20, FIG. 2. The magnet current delivered to the plasma device is then iteratively adjusted in response to the measured plasma discharge current oscillations to minimize the magnitude of plasma discharge current oscillations.

In one example, step 20 preferably includes iteratively measuring the AC component magnitude, e.g., a root-mean-square (RMS) value, of the plasma discharge current. Preferably, the slope of the AC component value is then calculated as a function of the plasma device magnet current, step 22. The change in the AC component magnitude that occurred between two measurement iterations is then divided by the change in the magnet current in the same interval. A determination is then made if the slope is positive or negative and the magnet current set point is changed by a predetermined amount in response to the determined slope, step 24. For example, if the slope is positive, the magnet current set point is decreased by a predetermined amount and if the slope is negative, the magnet current set point is increased by a predetermined amount. A determination is made if the magnet current set point is within allowable range of magnet current for a given plasma device operating point. If it is, the magnet current is changed. If it is not, the magnet current is not changed, step 26. Steps 20 to 26 are repeated while the plasma device is operational, indicated at 28. The predetermined magnet current change is dependent on the specific design of the plasma device, the number of turns in the magnet coil and a particular operating point of the plasma device. Typically the magnet current change is less than 5% of its nominal value.

In one embodiment, the method may be constrained by the DC value of the plasma discharge current. The method may also include measuring the peak-to-peak value of the AC component. In one example, the method may include measuring the frequency of the plasma discharge current oscillations and adjusting the magnet current to minimize the magnitude of the plasma discharge current oscillations based in the measured frequency.

Figure 3:
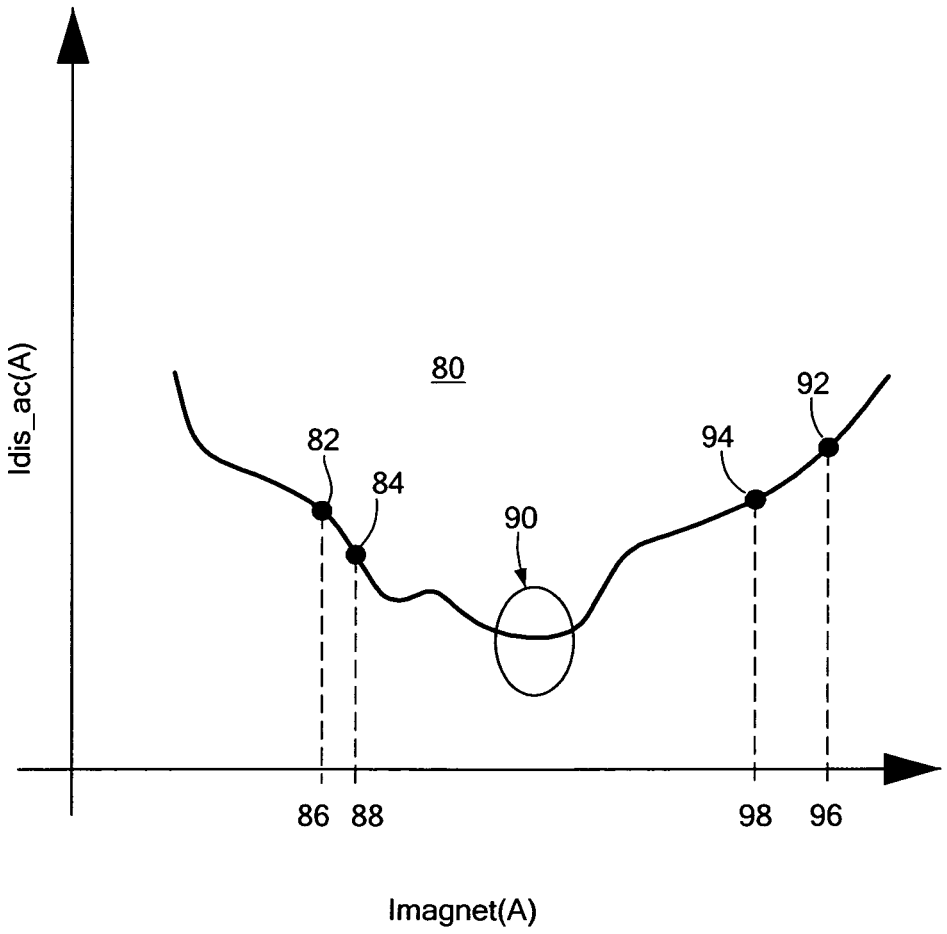
FIG. 3 is a plot depicting one example the iterative adjustment of the magnet current to minimize plasma discharge current oscillations using the method shown in FIG. 2.

Plot 80, FIG. 3, shows one example of operation of the autonomous method for minimizing the magnitude of plasma discharge current oscillations in a plasma device shown in FIG. 2. In this example, measured AC components of the plasma discharge current oscillations are indicated at 82 and 84, FIG. 3, for the magnet currents indicated at 86 and 88, respectively. Here, the change, or slope, between measured AC components 82, 84 at magnet current 86, 88 is negative, so the magnet current is increased to approach the desired target operation area 90 having minimized magnitude of plasma discharge current oscillations subject to predetermined limits or magnet current adjustability range. Similarly, other exemplary measured AC components of the plasma discharge current oscillations are indicated at 92, 94 for the magnet currents indicated at 96, 98, respectively. Here, the change, or slope, between measured AC components 92, 94 at magnet current 96, 98 is positive. In response thereto, the magnet current is decreased to approach the desired target operation area 90 having minimized magnitude of plasma discharge current oscillations.

Figure 4:
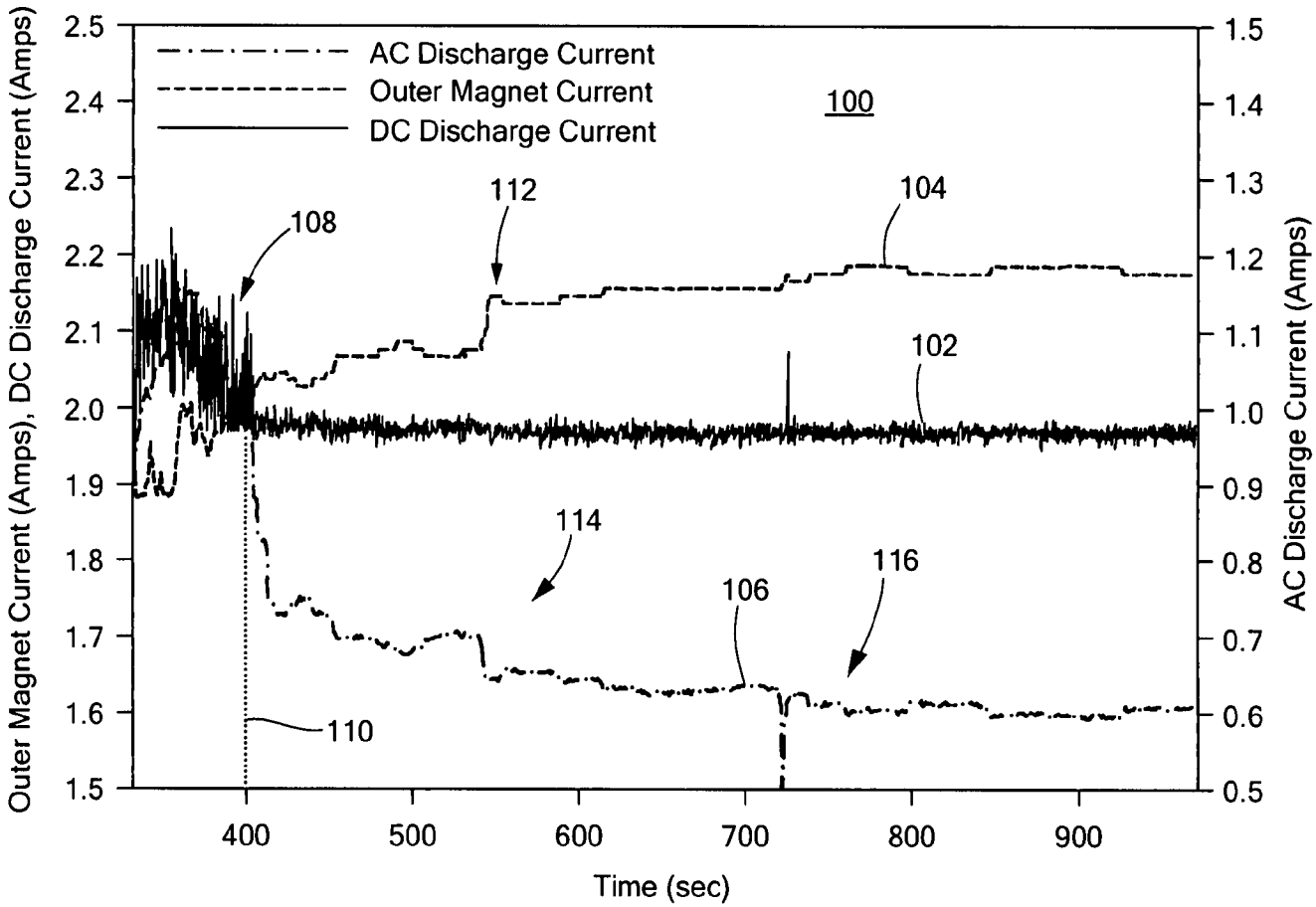
FIG. 4 is a histogram showing one example of the improved reduction in the magnitude of the plasma discharge oscillations in accordance with the method of one or more embodiment of this invention.

Histogram 100, FIG. 4, shows an example of the reduction of the magnitude of plasma discharge current oscillations in accordance the autonomous method for minimizing the magnitude of plasma discharge current oscillations in a plasma device of one embodiment of this invention. In this example, line 102 shows the DC discharge current over time, line 104 shows the magnet current delivered to the plasma device over time, and line 106 shows the AC component of the plasma discharge current over time. As shown at 108, before 400 sec, indicated at 110, the plasma device was jumping in and out of the "jet mode" and the magnitude of plasma discharge current oscillations were large. At 400 sec, the autonomous method for minimizing the magnitude of plasma discharge current oscillations in a plasma device of one or more embodiments of this invention discussed above with reference to FIGS. 2-3 was initiated. The magnet current started to increase, indicated at 112, suppressing the plasma discharge current oscillations, indicated at 114 until a minimum magnitude of plasma discharge current oscillations was reached, indicated at 116, e.g., at about 750 sec. At this point, the magnet current is autonomously and automatically going up and down hovering around the minimum of the AC plasma discharge current oscillations.

Figure 5:
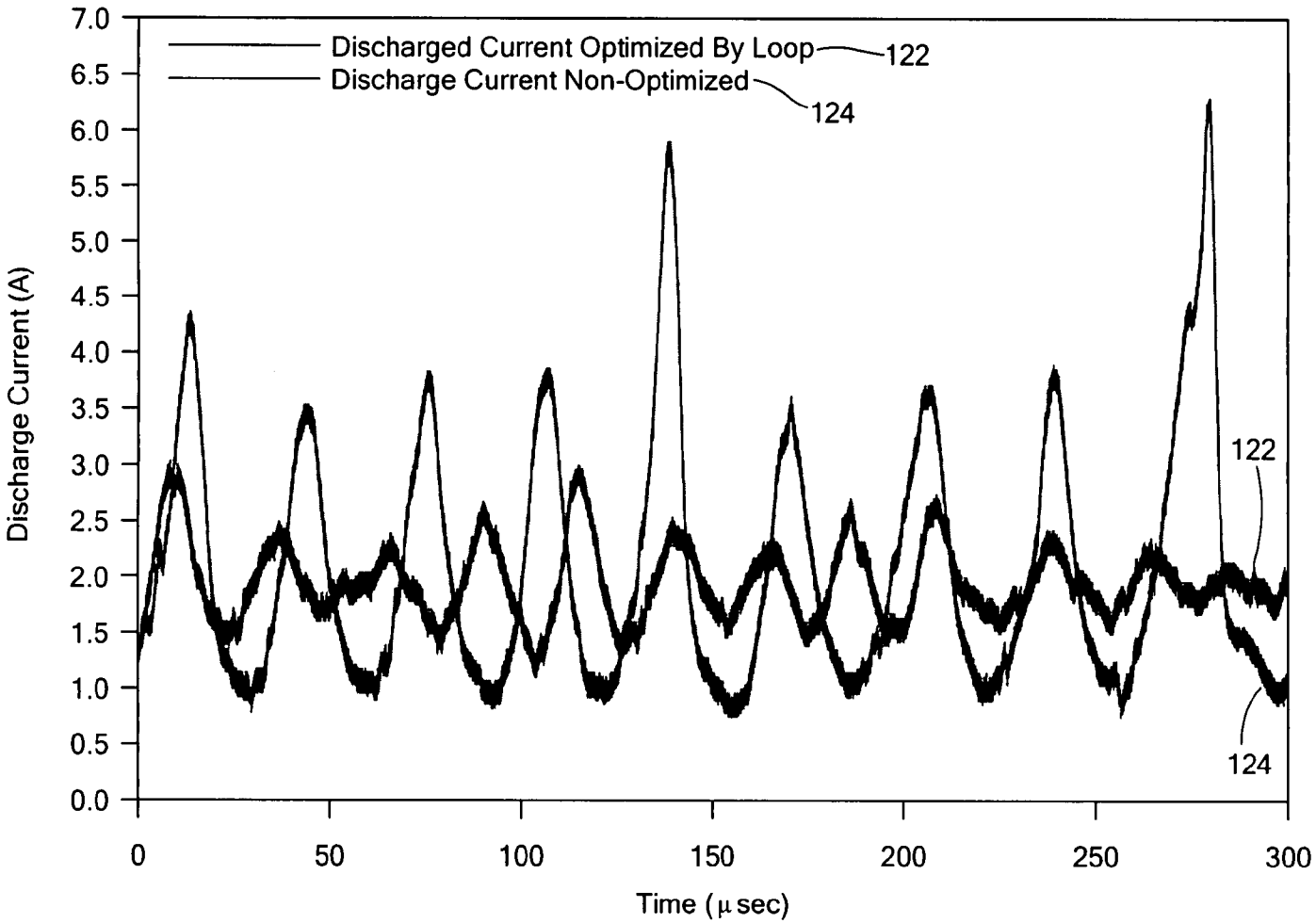
FIG. 5 is a histogram showing another example of the improved reduction of the magnitude of the plasma discharge oscillations in accordance with the method of one or more embodiments of this invention.

Histogram 120, FIG. 5, shows a comparison of plasma discharge current which has been processed with and without the autonomous method for minimizing the magnitude of plasma discharge current oscillations in a Hall effect plasma device of this invention. In this example, plot 122 shows plasma discharge current oscillations having minimized amplitude in accordance with one or more embodiment of the method of this invention and plot 124 shows an example of plasma discharge current oscillations with larger amplitude that have not been processed using the autonomous method for minimizing the magnitude of plasma discharge current oscillations in a plasma device of one or more embodiments of this invention. As can be seen, the autonomous method for minimizing the magnitude of plasma discharge current oscillations in a Hall effect plasma device of this invention significantly minimizes the magnitude or amplitude of plasma discharge current oscillations.

The result is the autonomous method for minimizing the magnitude of plasma discharge current oscillations in a Hall effect plasma device autonomous and automatically minimizes the magnitude of plasma discharge current oscillations. This may reduce plasma device erosion and extend plasma device lifetime, reduce plasma radiated electromagnet emissions, reduce the size of an output filter of the power processing unit. In terrestrial applications, the method of one or more embodiments of this invention may provide a steady plasma beam current for providing fabrication of microelectronic devices, and may provide steady plasma beam current that ensures deposition or sputtering is uniform.

Figure 6:
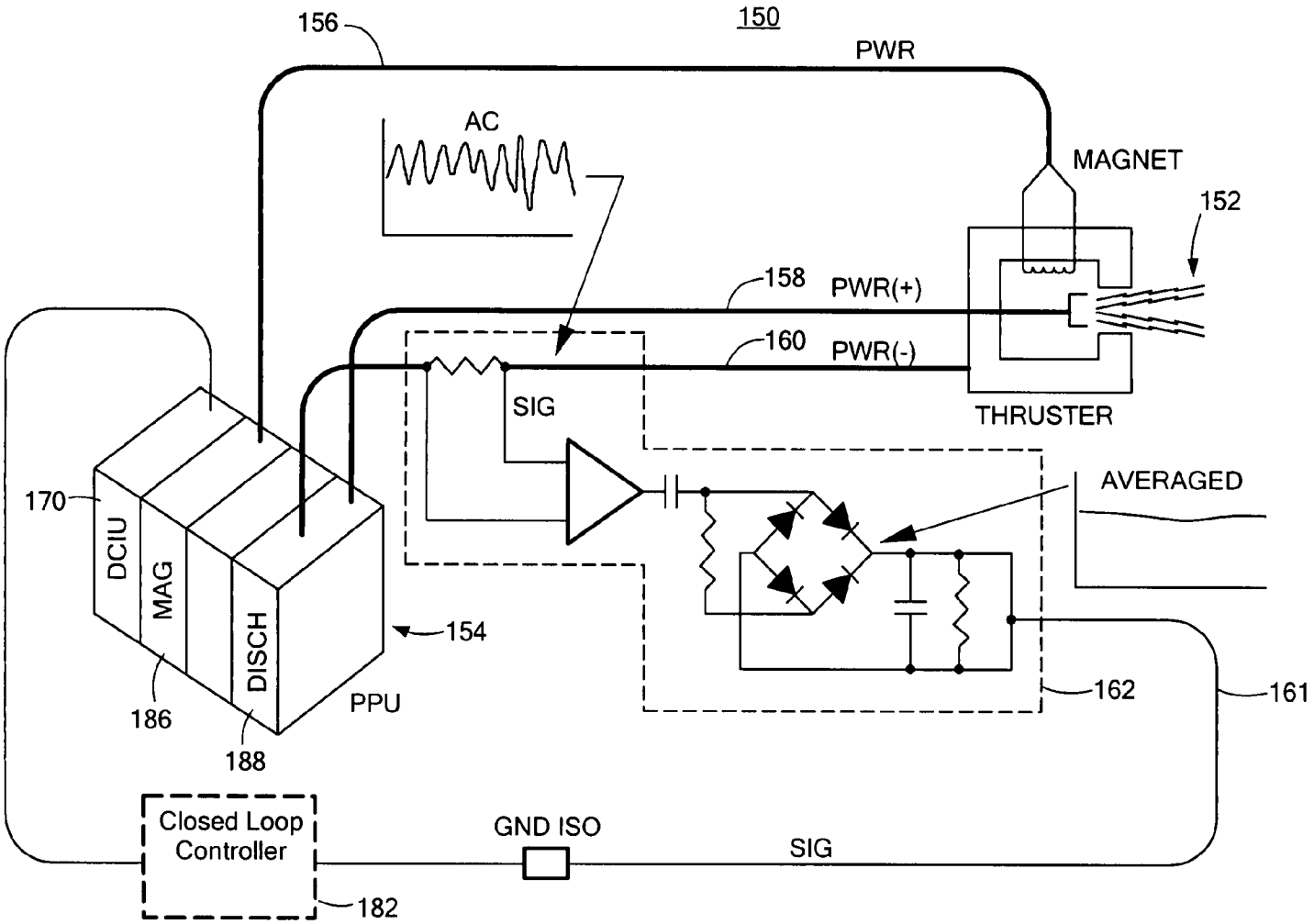
FIG. 6 is a schematic block diagram showing on example of the system for autonomously minimizing the magnitude of plasma discharge current oscillations in a Hall effect plasma device.

System 150, FIG. 6, for minimizing magnitude of plasma discharge oscillations in a Hall effect plasma device of one embodiment of this invention includes power processing unit 154 configured to produce magnet current by line 156 to plasma device 152 and provide power to plasma device 152 to establish plasma discharge current on lines 158 and 160 between plasma device 152 and power processing unit 154. System 150 also includes plasma discharge current oscillations measurement circuit 162 configured to measure plasma discharge current oscillations coupled to line 160 and output the measured plasma discharge current oscillations on line 161. System 10 also includes a closed loop controller responsive to the measured plasma discharge current on line 161 which iteratively adjusts the magnet current delivered by power processing unit 154 to plasma device 152 to minimize the magnitude of plasma discharge current oscillations on lines 158 and 160.

In one example, the closed loop controller may be part of digital control unit 170 of power processing unit 154, or it may be an analog closed loop controller 182. Power processing unit 154 may also include magnet power supply 186 and plasma discharge current power supply 188.

In one embodiment, the closed loop controller iteratively measures the AC component of the plasma discharge current oscillations. The closed loop controller may iteratively determine the change, or slope in the RMS value of the AC component. The closed loop controller may also determine if the change is a positive or a negative and iteratively increase the magnet current delivered by magnet power supply 186 on line 156 to plasma device 152 in response to a negative value or decrease the magnet current delivered by magnet power supply 186 by line 156 to plasma device 152 in response to the positive value until the magnitude of the plasma discharge current oscillations are minimized. The closed loop controller may also measure the peak-to-peak value of the AC component of the plasma discharge current oscillations. In one example, the closed loop controller may measure the frequency of the plasma discharge current oscillations by line 160 and change the magnet current to decrease the magnitude of the plasma discharge current oscillations in response to the measured frequency.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. An autonomous method for minimizing the magnitude of plasma discharge current oscillations in a Hall effect plasma device, the method comprising:

iteratively measuring the plasma discharge current oscillations of the plasma device;

iteratively adjusting a magnet current delivered to the plasma device in response to the measured plasma discharge current oscillations to minimize the magnitude of the plasma discharge current oscillations.

2. The method of claim 1 in which adjusting the magnet current delivered to the plasma device in response to the measured plasma discharge current oscillations is constrained by a DC value of the plasma discharge current oscillations.

3. The method of claim 1 further including iteratively measuring an AC component magnitude of the plasma discharge current oscillations.

4. The method of claim 1 further including determining the root-mean-square (RMS) value of the plasma discharge current oscillations.

5. The method of claim 3 further including calculating the slope of an AC component value as a function of the magnet current.

6. The method of claim 5 further including determining if the slope is positive or negative.

7. The method of claim 6 further including changing magnet current set point by a predetermined amount in response to the determined slope.

8. The method of claim 7 further including decreasing the magnet current set point when the slope is positive and increasing the magnet current set point when the slope is negative.

9. The method of claim 7 further including determining if the magnet current set point is within an allowable range of magnet current for a given plasma device operating point.

10. The method of claim 9 further including changing the magnet current when the current set point is within the allowable range.

11. The method of claim 9 further including not changing the magnet current when the current set point is outside the allowable range.

12. The method of claim 3 further including measuring the peak-to-peak value of an AC component.

13. The method of claim 1 further including measuring the frequency of the plasma discharge current oscillations and adjusting the magnet current to reduce the magnitude of the plasma discharge current oscillations based on the measured frequency.

14. An autonomous method for minimizing the magnitude of plasma discharge current oscillations of a Hall effect plasma device, the method comprising:

iteratively measuring the plasma discharge current oscillations of the plasma device; and iteratively adjusting a magnet current delivered to the plasma device in response to the measured plasma discharge current oscillations to reduce the magnitude of the plasma discharge current oscillations constrained by a DC value of the plasma discharge current oscillations.

15. A system for minimizing the magnitude of plasma discharge oscillations of a Hall effect plasma device, the system comprising:

a power processing unit configured to provide magnet current and power to the plasma device to establish plasma discharge current;

a plasma discharge current measurement circuit configured to measure the plasma discharge current oscillations; and a closed loop controller responsive to the measured plasma discharge current oscillations configured to iteratively adjust the magnet current delivered to the plasma device in response to the measured plasma discharge current oscillations to reduce the magnitude of plasma discharge current oscillations.

16. The system of claim 15 in which the closed loop controller is configured to iteratively measure an AC component magnitude of the plasma discharge current oscillations.

17. The system of claim 15 in which the closed loop controller is configured to determine the root-mean-square (RMS) value of the plasma discharge current oscillations.

18. The system of claim 16 in which the closed loop controller is configured to calculate the slope of an AC component value as a function of the magnet current.

19. The system of claim 17 in which the closed loop controller is configured to determine if the slope is positive or negative.

20. The system of claim 19 in which the closed loop controller is configured to change a magnet current set point by a predetermined amount in response to the determined slope.

21. The system of claim 19 in which the closed loop controller is configured to decrease a magnet current set point when the slope is positive and increase the magnet current set point when the slope is negative.

22. The system of claim 21 in which the closed loop controller is configured to determine if the magnet current set point is within an allowable range of magnet current for a given plasma device operating point.

23. The system of claim 22 in which the closed loop controller is configured to change the magnet current when the current set point is within the allowable range.

24. The system of claim 22 in which the closed loop controller is configured to not change the magnet current when the current set point is outside the allowable range.

25. The system of claim 15 in which the closed loop controller is configured to determine the peak-to-peak value of an AC component.

26. The system of claim 15 in which the closed loop controller is configured to measure the frequency of the plasma discharge current oscillations and adjust the magnet current to reduce the magnitude of the plasma discharge current oscillations based on the measured frequency.

* * * * *